US012491419B2

(12) United States Patent
Gu

(10) Patent No.: US 12,491,419 B2
(45) Date of Patent: Dec. 9, 2025

(54) MULTIFUNCTIONAL TENNIS NET

(71) Applicant: Bingrong Gu, Ji 'an (CN)

(72) Inventor: Bingrong Gu, Ji 'an (CN)

( * ) Notice: Subject to any disclaimer, the term of this patent is extended or adjusted under 35 U.S.C. 154(b) by 881 days.

(21) Appl. No.: 17/743,527

(22) Filed: May 13, 2022

(65) Prior Publication Data

US 2023/0310958 A1 Oct. 5, 2023

(30) Foreign Application Priority Data

Apr. 4, 2022 (CN) ..... 202220765557.4

(51) Int. Cl.

| | |
|---|---|
| ***A63B 61/00*** | (2006.01) |
| ***A63B 61/02*** | (2006.01) |
| ***A63B 69/00*** | (2006.01) |

(52) U.S. Cl.

CPC ..... *A63B 61/006* (2013.01); *A63B 61/02* (2013.01); *A63B 69/0097* (2013.01)

(58) Field of Classification Search

CPC .... A63B 61/006; A63B 61/02; A63B 69/0097
See application file for complete search history.

(56) References Cited

U.S. PATENT DOCUMENTS

| | | | | |
|---|---|---|---|---|
| 2004/0132558 | A1* | 7/2004 | Rothman | A63B 69/002 473/434 |
| 2016/0303446 | A1* | 10/2016 | Free | A63B 61/02 |
| 2017/0291091 | A1* | 10/2017 | Khidhr | A63B 61/006 |
| 2023/0141648 | A1* | 5/2023 | McLellan | A63B 67/002 473/492 |

FOREIGN PATENT DOCUMENTS

| | | | | |
|---|---|---|---|---|
| AU | 637566 | B1 * | 5/1993 | A63B 61/02 |
| CN | 111840945 | A * | 10/2020 | A63B 61/00 |
| JP | 2004024885 | A * | 1/2004 | |
| JP | 3210065 | U * | 4/2017 | A63B 61/003 |
| WO | WO-2011070662 | A1 * | 6/2011 | A63B 69/0097 |

* cited by examiner

*Primary Examiner* — Jeffrey S Vanderveen
(74) *Attorney, Agent, or Firm* — Birchwood IP

(57) ABSTRACT

A multifunctional tennis net, comprising a pair of nets, wherein the pair of nets are arranged side by side or in a vertical direction, the pair of nets comprises two independent meshes which are bonded by Velcro. The upper and lower sides of the nets are provided with second connecting pipes, and the left and right sides of the nets are provided with first connecting pipes. The bottom of the first connecting pipes are movably inserted with a bracket, and the outer wall of the first connecting pipes are sleeved with T-shaped sleeves and Z-shaped sleeves. The first connecting pipes are movably plugged with the second connecting pipes through the T-shaped sleeves, the first connecting pipes are movably plugged with the brackets through the Z-shaped sleeves, and the T-shaped sleeves and the Z-shaped sleeves are provided with positioning holes.

6 Claims, 3 Drawing Sheets

MULTIFUNCTIONAL TENNIS NET

TECHNICAL FIELD

The present application relates to the technical field of sports equipment, in particular to a multifunctional tennis net.

BACKGROUND

As an important part of physical education, tennis can not only strengthen the body, relax and entertain, but also win glory for the country. It is a relatively elegant and fashionable sports activity. Tennis nets need to be used in the tennis teaching process. The tennis nets are a tool to separate the active areas of the two sides, but the existing tennis nets can only be used as a net, not a rebound training net, and have a single function.

SUMMARY OF THE APPLICATION

The purpose of the present application is to propose a multifunctional tennis net in order to solve the shortcoming of the single function of the tennis net in the prior art.

In order to achieve the above object, the application adopts the following technical solutions:

A multifunctional tennis net, comprising a pair of nets, wherein the pair of nets are arranged side by side or in a vertical direction, the pair of nets comprises two independent meshes which are bonded by a fastener, the upper and lower sides of the nets are provided with second connecting pipes, and the left and right sides of the nets are provided with first connecting pipes, the bottom of the first connecting pipe is movably inserted with brackets.

Preferably, the outer wall of the first connecting pipes are sleeved with T-shaped sleeves and a Z-shaped sleeves, the first connecting pipes are movably plugged with the second connecting pipes through the T-shaped sleeves, the first connecting pipes are movably plugged with the brackets through the Z-shaped sleeves, and the T-shaped sleeves and the Z-shaped sleeves are provided with positioning holes.

Preferably, the outer walls of the first connecting pipes and the second connecting pipes are welded with a plurality of hanging rings, a plurality of elastic hooks are connected to the edge of the nets, and the elastic hooks are configured to be hung on the hanging ring, so that the nets can be tightened.

Preferably, the pair of the nets are configured to be detachably arranged side by side, and the bracket comprises third connecting pipes and fourth connecting pipes, the third connecting pipe and the fourth connecting pipe are both plugged with the Z-shaped sleeves and are arranged on both sides of the first connecting pipe, an "H"-type sleeve is sleeved on the second connecting pipe, and the "H"-shaped sleeve is formed by a pair of the T-shaped sleeves inserted into each other, and the "H"-shaped sleeve is configured to be flush with the bracket.

Preferably, the outer wall of the fourth connecting pipe is provided with a pressing buckle, the outer wall of the third connecting pipe is provided with a positioning holes, the third connecting pipe and the fourth connecting pipe are inserted into the T-shaped sleeve, the pressing buckle is configured to pass through the third connecting pipe and the positioning hole on the T-shaped sleeve and lock in the positioning hole.

Preferably, the pair of the nets are arranged vertically, and the brackets comprise second connecting pipes, third connecting pipes and fourth connecting pipes, one end of the third connecting pipe is plugged with the Z-shaped sleeve, and the other end of the third connecting pipe is also provided with a Z-shaped sleeve, the second connecting pipe is inserted between a pair of the Z-shaped sleeves.

Preferably, the bracket is configured to be rotatably connected to the third connecting pipe, and the fourth connecting pipe is configured to be inserted into the third connecting pipe, and the end of the fourth connecting pipe is inserted into a socket opened on the first connecting pipe to support the first connecting pipe.

Preferably, the Z-shaped sleeve and the T-shaped sleeve are both bendable sleeves, the position where the third connecting pipe is inserted into the fourth connecting pipe is adjusted, and the Z-shaped sleeve and the T-shaped sleeve are configured to be bent to form an inverted "V"-shaped double-sided multiplayer Rebound tennis net.

The multifunctional tennis net proposed by the application have the beneficial effects of: By arranging the detachable bracket and the net, when the nets are arranged side by side, they can be used as ordinary tennis nets. At the same time, the ordinary net is spliced together by two separate nets, which can be split to form two small-sized nets, which is suitable for situations where the amount of exercise is small and the field is small. When the net is set vertically, it can be used as single rebound training net. Adjust the position where the third connecting pipe is inserted into the fourth connecting pipe, bend the Z-shaped sleeve and the T-shaped sleeve to form an inverted "V" shape, thereby forming a double-sided multi-person rebounding tennis net. When the installation method of the entire net is changed, all parts can be used together, which solves the problem of single function of the traditional net, and the disassembly and assembly process is simple and easy to operate.

1. First connecting pipe, 2. Second connecting pipe, 3. Third connecting pipe,
4. Fourth connecting pipe, 5. T-shaped sleeve, 6 Z-shaped sleeve, 7 Tennis net,
8 bracket, 9 "H"-shaped sleeve, 10 Pressing buckle, 11 Positioning hole.

DETAILED DESCRIPTION

The technical solutions in the embodiments of the present application will be clearly and completely described below with reference to the drawings in the embodiments of the present application. Obviously, the described embodiments are only a part of the embodiments of the present application, rather than all the embodiments.

Embodiment 1

Figure 1:
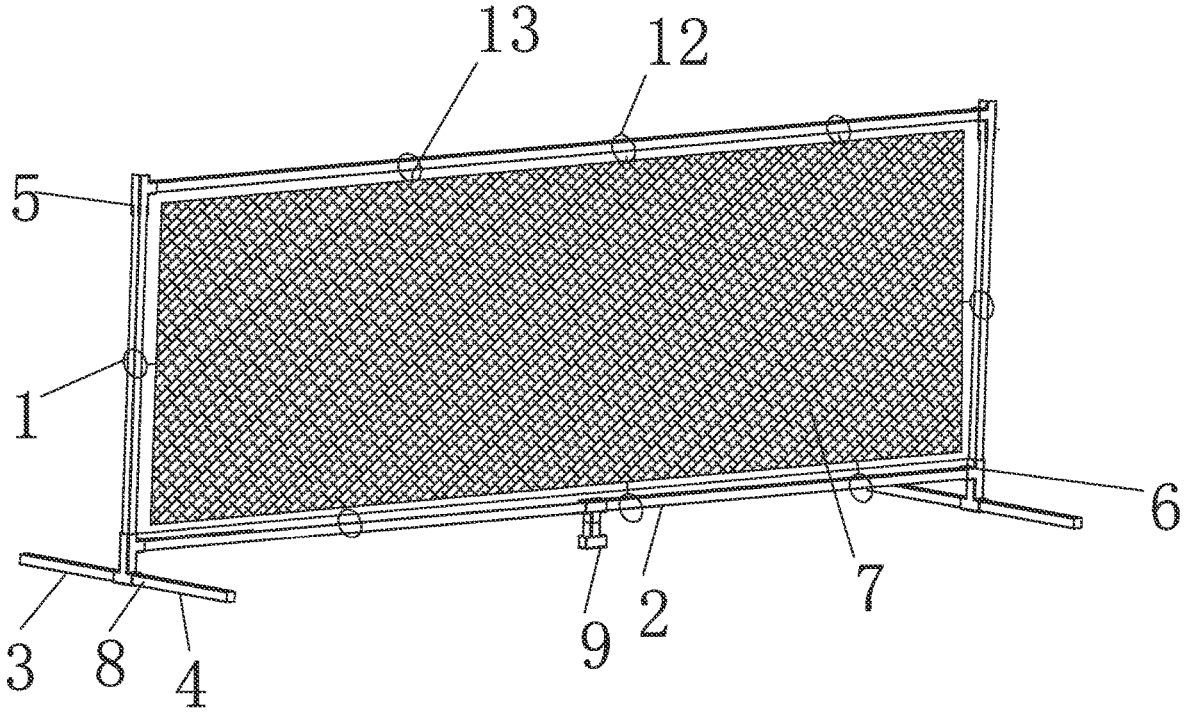
FIG. 1 is a schematic structural diagram of the net of a multifunctional tennis net proposed by the application.
Figure 2:
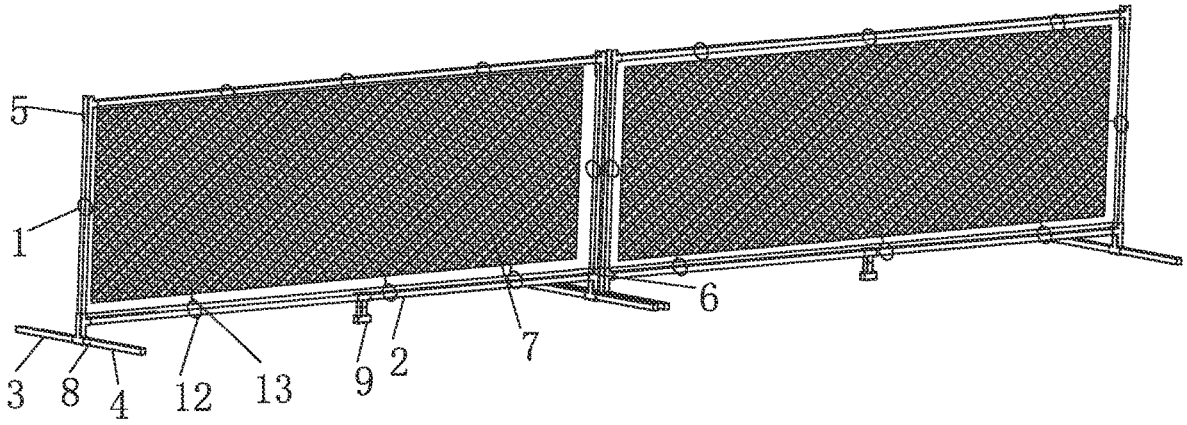
FIG. 2 is a schematic structural diagram of a multifunctional tennis net proposed by the application when the nets are arranged side by side.
Figure 3:
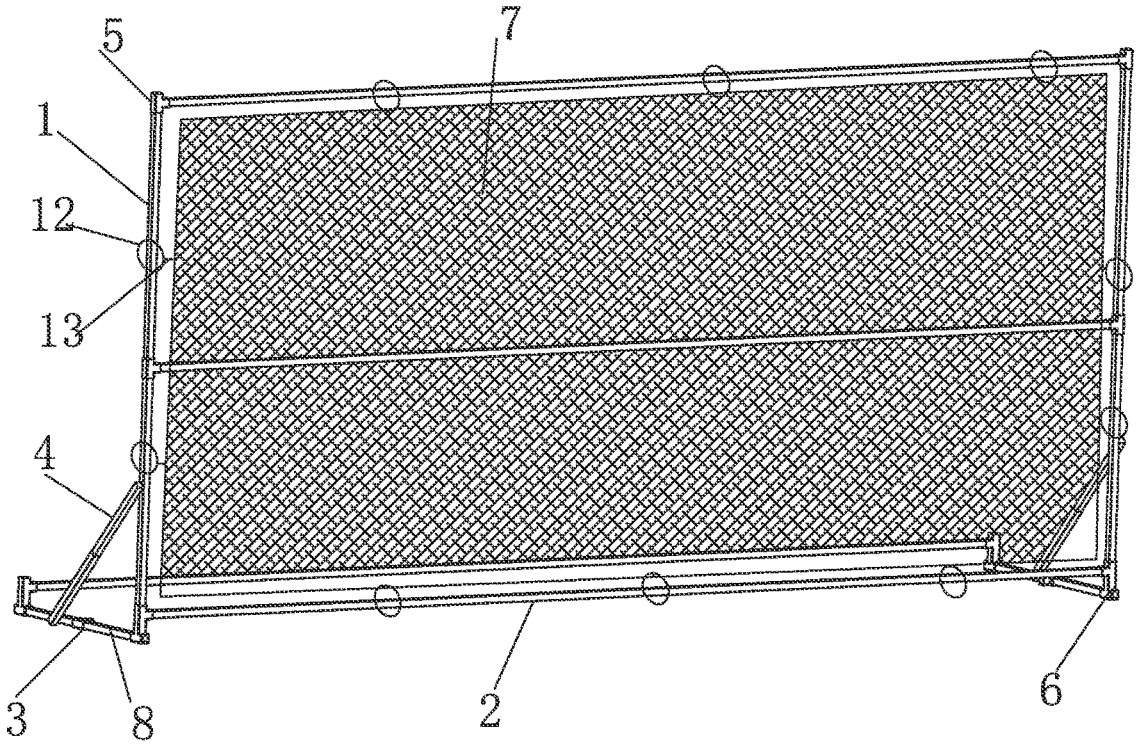
FIG. 3 is a schematic structural diagram of a multifunctional tennis net proposed by the application when the nets are vertically arranged.
Figure 4:
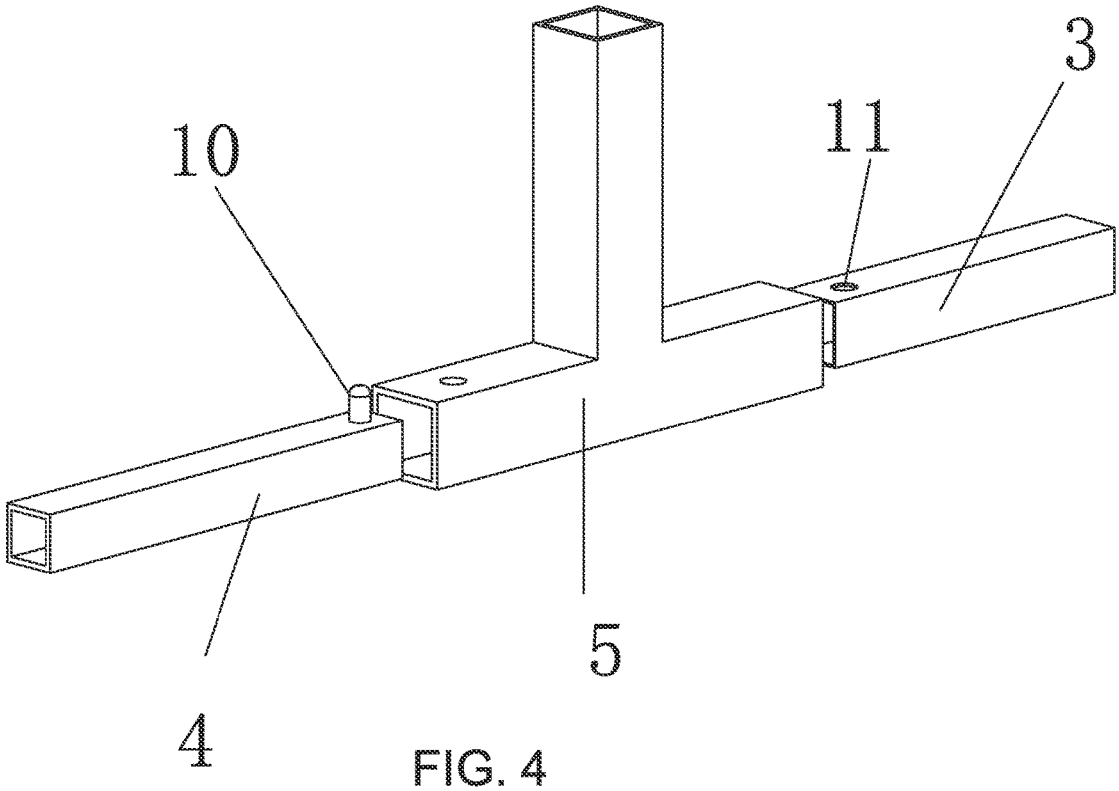
FIG. 4 is a schematic diagram of the connection structure of the second connecting pipe, the third connecting pipe and the T-shaped sleeve of a multifunctional tennis net proposed by the application.
Figure 5:
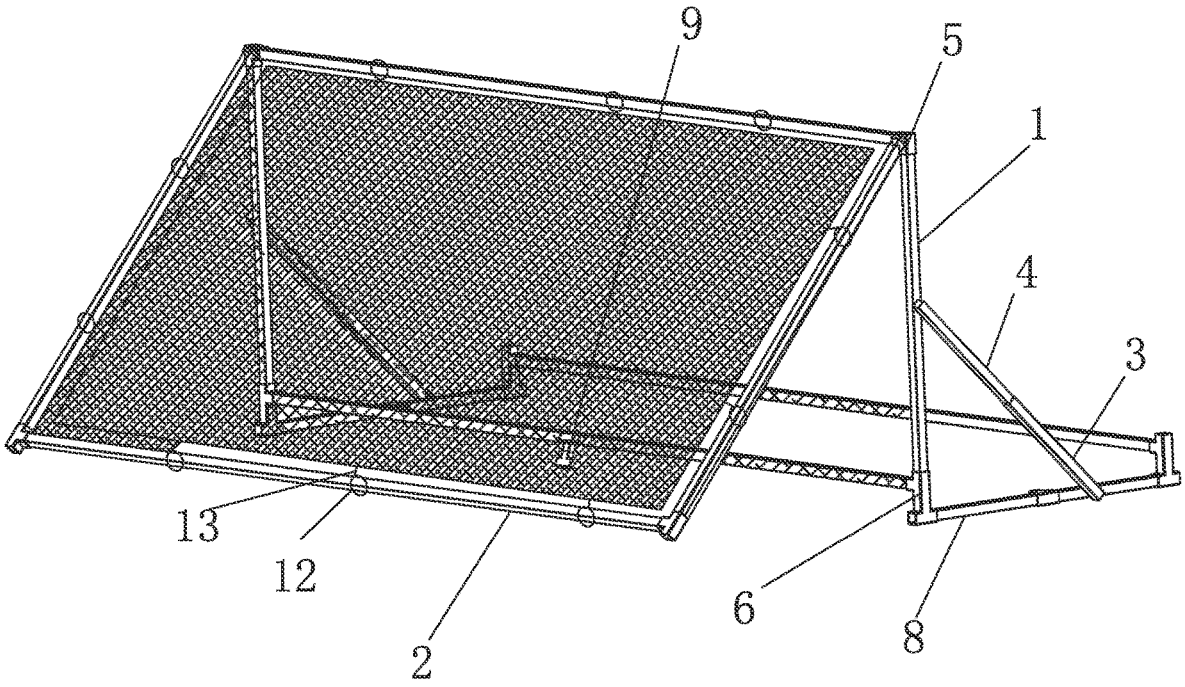
FIG. 5 is a schematic structural diagram of a multifunctional tennis net proposed by the application when the nets are vertically arranged and bent.

Referring to FIGS. 1-2, a multifunctional tennis net comprising a pair of nets 7, wherein the pair of nets 7 are arranged side by side, the pair of nets 7 comprises two independent meshes which are bonded by a fastener, the upper and lower sides of the nets 7 are provided with second connecting pipes 2, and the left and right sides of the nets 7 are provided with first connecting pipes 1, the bottom of the first connecting pipe 1 is movably inserted with bracket 8.

The outer wall of the first connecting pipes 1 are sleeved with T-shaped sleeves 5 and a Z-shaped sleeves 6, the first connecting pipes 1 are movably plugged with the second connecting pipes 2 through the T-shaped sleeves 5, the first connecting pipes 1 are movably plugged with the brackets 8 through the Z-shaped sleeves 6, and the T-shaped sleeves 5 and the Z-shaped sleeves 6 are provided with positioning holes 11.

The outer walls of the first connecting pipes 1 and the second connecting pipes 2 are welded with a plurality of hanging rings 12, a plurality of elastic hooks 13 are connected to the edge of the nets 7, and the elastic hooks 13 are configured to be hung on the hanging ring 12, so that the nets 7 can be tightened.

The pair of the nets 7 are configured to be detachably arranged side by side, and the bracket 8 comprises third connecting pipes 3 and fourth connecting pipes 4, the third connecting pipe 3 and the fourth connecting pipe 4 are both plugged with the Z-shaped sleeves 6 and are arranged on both sides of the first connecting pipe 1, an "H"-type sleeve 9 is sleeved on the second connecting pipe 2, and the "H"-shaped sleeve is formed by a pair of the T-shaped sleeves 5 inserted into each other, and the "H"-shaped sleeve 9 is configured to be flush with the bracket 8.

The outer wall of the fourth connecting pipe 4 is provided with a pressing buckle 10, the outer wall of the third connecting pipe 3 is provided with a positioning holes 11, the third connecting pipe 3 and the fourth connecting pipe 4 are inserted into the T-shaped sleeve 5, the pressing buckle 10 is configured to pass through the third connecting pipe 3 and the positioning hole 11 on the T-shaped sleeve 5 and lock in the positioning hole.

Embodiment 2

Referring to FIGS. 3-5-2, a multifunctional tennis net comprising a pair of nets 7, wherein the pair of nets 7 are arranged in vertical direction, the pair of nets 7 comprises two independent meshes which are bonded by a fastener, the upper and lower sides of the nets 7 are provided with second connecting pipes 2, and the left and right sides of the nets 7 are provided with first connecting pipes 1, the bottom of the first connecting pipe 1 is movably inserted with bracket 8.

The outer wall of the first connecting pipes 1 are sleeved with T-shaped sleeves 5 and a Z-shaped sleeves 6, the first connecting pipes 1 are movably plugged with the second connecting pipes 2 through the T-shaped sleeves 5, the first connecting pipes 1 are movably plugged with the brackets 8 through the Z-shaped sleeves 6, and the T-shaped sleeves 5 and the Z-shaped sleeves 6 are provided with positioning holes 11.

The outer walls of the first connecting pipes 1 and the second connecting pipes 2 are welded with a plurality of hanging rings 12, a plurality of elastic hooks 13 are connected to the edge of the nets 7, and the elastic hooks 13 are configured to be hung on the hanging ring 12, so that the nets 7 can be tightened.

The pair of the nets 7 are configured to be detachably arranged vertically, and the brackets 8 comprise second connecting pipes 2, third connecting pipes 3 and fourth connecting pipes 4, one end of the third connecting pipe 3 is plugged with the Z-shaped sleeve 6, and the other end of the third connecting pipe 3 is also provided with a Z-shaped sleeve 6, the second connecting pipe 2 is inserted between a pair of the Z-shaped sleeves 6.

The bracket 8 is configured to be rotatably connected to the third connecting pipe 3, and the fourth connecting pipe 4 is configured to be inserted into the third connecting pipe 3, and the end of the fourth connecting pipe 4 is inserted into a socket opened on the first connecting pipe 1 to support the first connecting pipe 1.

The Z-shaped sleeve 6 and the T-shaped sleeve 5 are both bendable sleeves, the position where the third connecting pipe 3 is inserted into the fourth connecting pipe 4 is adjusted, and the Z-shaped sleeve 6 and the T-shaped sleeve 5 are configured to be bent to form an inverted "V"-shaped double-sided multiplayer Rebound tennis net.

The above are only the preferred embodiments of the present application, and are not intended to limit the present application. Therefore, any modification, equivalent replacement, improvement, etc. made to the above embodiments according to the technical practice of the present application still fall within the scope of the technical solution of the present application.

What is claimed is:

1. A multifunctional tennis net, comprising a pair of nets, wherein the pair of nets are arranged side by side or in a vertical direction, the pair of nets comprise two independent meshes which are bonded by a fastener, upper and lower sides of the pair of nets are provided with second connecting pipes, and left and right sides of the pair of nets are provided with first connecting pipes, bottoms of the first connecting pipes are movably inserted with brackets;

wherein the pair of nets are arranged vertically, and the brackets comprise the second connecting pipes, third connecting pipes and fourth connecting pipes, ends of the third connecting pipes are plugged with Z-shaped sleeves, and other ends of the third connecting pipes are further provided with the Z-shaped sleeves, the second connecting pipes are inserted between a pair of the Z-shaped sleeves;

wherein the Z-shaped sleeves and T-shaped sleeves are both bendable sleeves, positions where the third connecting pipes are inserted into the fourth connecting pipes are adjustable, and the Z-shaped sleeves and the T-shaped sleeves are configured to be bent to form an inverted "V"-shaped double-sided multiplayer rebound tennis net.

2. The multifunctional tennis net according to claim 1, wherein outer walls of the first connecting pipes are sleeved with the T-shaped sleeves and the Z-shaped sleeves, the first connecting pipes are movably plugged with the second connecting pipes through the T-shaped sleeves, the first connecting pipes are movably plugged with the brackets through the Z-shaped sleeves, and the T-shaped sleeves and the Z-shaped sleeves are provided with positioning holes.

3. The multifunctional tennis net according to claim 1, wherein the outer walls of the first connecting pipes and the second connecting pipes are welded with a plurality of hanging rings, a plurality of elastic hooks are connected to edges of the pair of nets, and the elastic hooks are configured to be hung on the hanging rings, so that the pair of nets are tightened.

4. The multifunctional tennis net according to claim 1, wherein the pair of nets are configured to be detachably arranged side by side, and the brackets comprise the third connecting pipes and the fourth connecting pipes, the third connecting pipes and the fourth connecting pipes are both plugged with the Z-shaped sleeves, and are arranged on both sides of the first connecting pipes, an "H"-shaped sleeve is sleeved on the second connecting pipes, and the "H"-shaped sleeve is formed by a pair of the T-shaped sleeves inserted into each other, and the "H"-shaped sleeve is configured to be flush with the brackets.

5. The multifunctional tennis net according to claim 4, wherein outer walls of the fourth connecting pipes are provided with a pressing buckle, outer walls of the third connecting pipes are provided with the positioning holes, the third connecting pipes and the fourth connecting pipes are inserted into the T-shaped sleeves, the pressing buckle is configured to pass through the third connecting pipes and the positioning holes on the T-shaped sleeves and lock in the positioning holes.

6. The multifunctional tennis net according to claim 1, wherein the brackets are configured to be rotatably connected to the third connecting pipes, and the fourth connecting pipes are configured to be inserted into the third connecting pipes, and ends of the fourth connecting pipes are inserted into a socket provided on the first connecting pipes to support the first connecting pipes.

* * * * *